United States Patent [19]

Latsch et al.

[11] 4,161,162

[45] Jul. 17, 1979

[54] METHOD AND APPARATUS FOR CONTROLLING THE OPERATION OF AN INTERNAL COMBUSTION ENGINE

[75] Inventors: Reinhard Latsch, Vaihingen; Valerio Bianchi, Leonberg, both of Fed. Rep. of Germany

[73] Assignee: Robert Bosch GmbH, Stuttgart, Fed. Rep. of Germany

[21] Appl. No.: 815,383

[22] Filed: Jul. 7, 1977

Related U.S. Application Data

[63] Continuation of Ser. No. 564,073, Apr. 1, 1975, abandoned.

[30] Foreign Application Priority Data

Apr. 9, 1974 [DE] Fed. Rep. of Germany ..... 2417187

[51] Int. Cl.[2] ..... F02B 3/00

[52] U.S. Cl. ..... 123/32 EA; 123/119 R

[58] Field of Search ..... 123/32 EA, 139 E; 332/9 T; 317/5; 73/117.3, 517 A, 70.1

[56] References Cited

U.S. PATENT DOCUMENTS

| | | | |
|---|---|---|---|
| 2,655,036 | 10/1953 | Chapman | 73/517 A |
| 3,508,254 | 4/1970 | Ross | 73/517 A |
| 3,583,225 | 6/1971 | Wing | 73/517 A |
| 3,789,816 | 2/1974 | Taplin | 123/32 EA |
| 3,800,599 | 4/1974 | Goran | 123/32 EA |
| 3,872,846 | 3/1975 | Taplin | 123/32 EA |
| 3,901,086 | 8/1975 | Griffiths | 73/517 A |

*Primary Examiner*—Ronald B. Cox
*Attorney, Agent, or Firm*—Edwin E. Greigg

[57] ABSTRACT

An electronic control circuit for operating an internal combustion engine near its lean running limit includes means for measuring the scattering bandwidth of the cyclic fluctuations of the combustion chamber pressure. This measurement is made indirectly by measuring the angular speed a rotating engine member, e.g., the crankshaft, and by forming and storing an appropriate analog signal. Circuitry is provided which supplies a nominal value of the scattering bandwidth which is compared electrically with the measured actual value. An appropriately processed difference signal is fed to a fuel injection controller which changes the fuel-air mixture to the desired ratio.

24 Claims, 16 Drawing Figures

Fig. 11
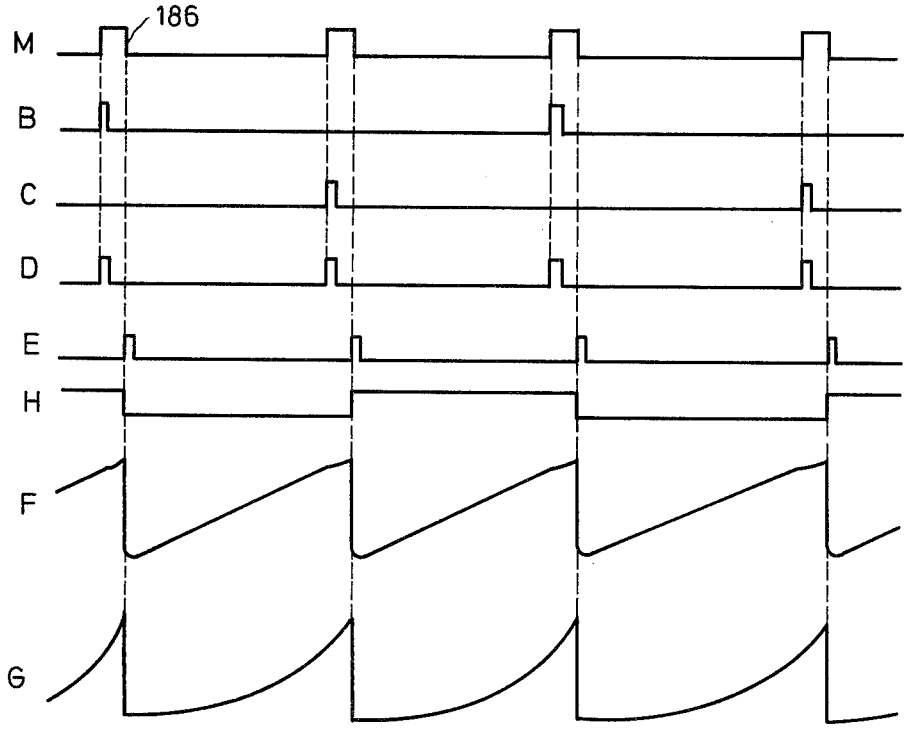
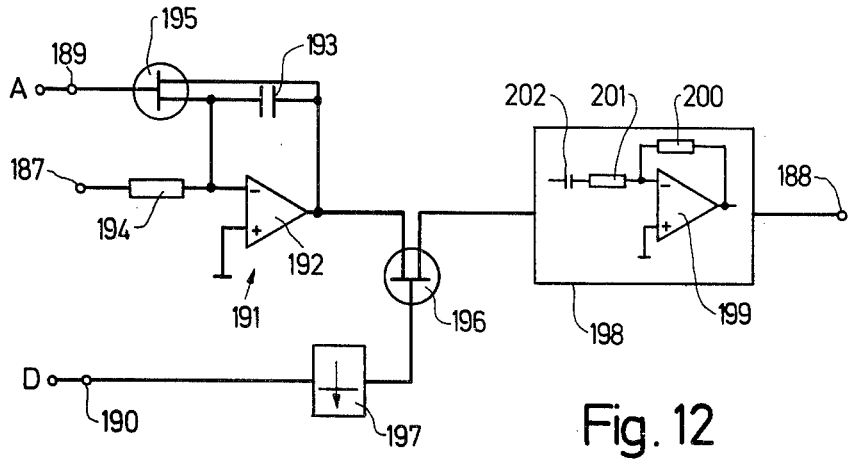
Fig. 12

Fig. 13
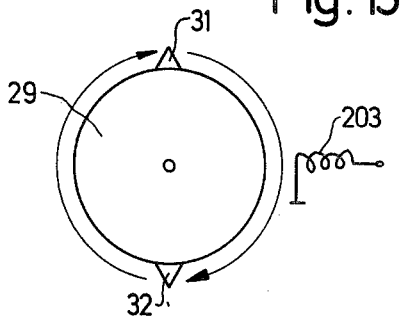
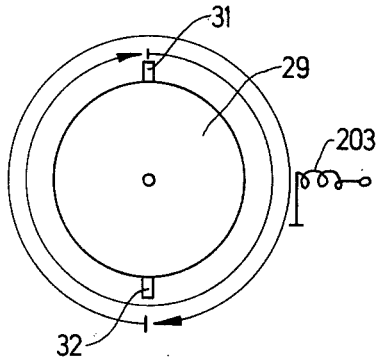
Fig. 14
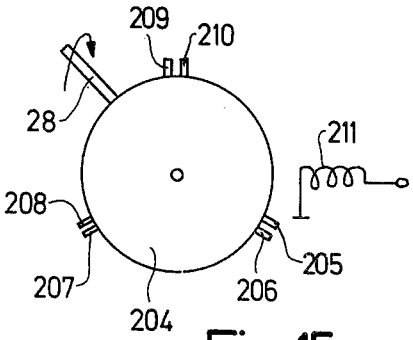
Fig. 15
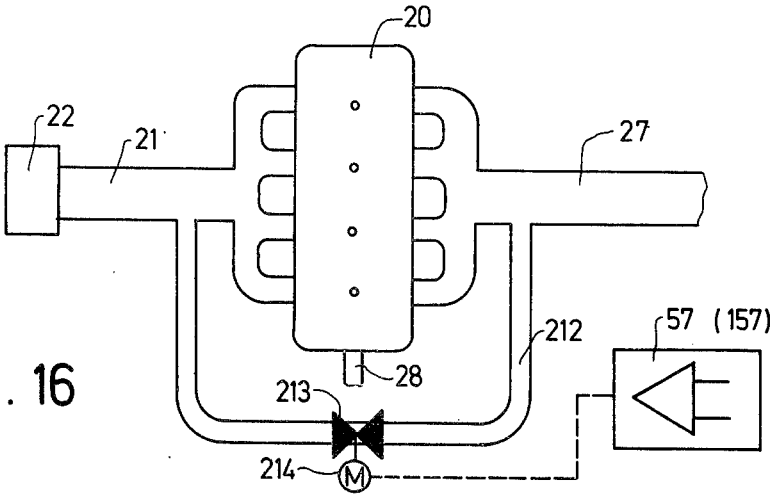
Fig. 16

METHOD AND APPARATUS FOR CONTROLLING THE OPERATION OF AN INTERNAL COMBUSTION ENGINE

This is a continuation of application Ser. No. 564,073, filed Apr. 1, 1975 and now abandoned.

BACKGROUND OF THE INVENTION

The invention relates to a method for controlling the operation of an internal combustion engine within a predetermined operational domain.

Due to the increasingly rigorous regulations concerning exhaust gas composition and in view of the general fuel shortage, there is a need for methods and means for operating internal combustion engines in a domain wherein the toxic components of the exhaust gas can be reduced to a minimum and/or in which a minimum amount of fuel is used.

The most obvious solution to meet such requirements is to operate the internal combustion engine with as lean a fuel-air mixture as possible, i.e., to operate the engine along the so-called lean running limit of the engine. In this operational domain, one may assume that the exhaust gas is relatively free from toxic components and that the fuel consumption will be relatively low. One of the possible parameters which characterizes the lean running limit appears to be the pressure in the cylinders of an internal combustion engine. When using this solution, the fuel-air mixture which is delivered to the internal combustion engine can be influenced by either enriching it with fuel or by making it leaner in dependence on the pressures as measured in the cylinders.

However, when this problem is considered more carefully, it is found that the pressure in the cylinders of the internal combustion engine is subject to considerable fluctuations which derive partly from uncontrollable operational conditions of the internal combustion engine, for example fluctuations of the air number of the charge and turbulence. When the pressure in the combustion chamber is determined from measurements of the angular speed of the crankshaft, there are additional error-producing influences, caused, for example, by the oscillating masses of the drive means for the crankshaft, an unevenness of the road on which the vehicle travels or by some other forces acting on the engine block of the internal combustion engine.

These fluctuations are superimposed on the normal pressure curve in a cylinder of the internal combustion engine and they result in fluctuations of the angular velocity of the crankshaft. These superimposed oscillations might be removed by the use of low-pass filters, but the use of such filters invites considerable problems because the internal combustion engine is to be operated in a wide rpm domain and it is very difficult to find filters which are equally suitable at both low and high rpm's (frequencies).

OBJECT AND SUMMARY OF THE INVENTION

Based on these above stated problems, it is a principal object of the invention to provide a method which permits the regulation of the internal combustion engine within a particular operational domain without incurring the above cited difficulties or disadvantages.

This object is attained, according to the invention in that the fuel-air ratio of the mixture provided to the internal combustion engine and/or the quantity of recycled exhaust gas in the internal combustion engine is altered in dependence on the magnitude of the dispersion or scattering of the values of the cyclic variations in the average combustion chamber pressure as measured during time intervals which are in synchronism with the engine rpm.

It is a further object of the invention to provide an apparatus for carrying out the above-described method which permits a simple and reliable regulation of the engine. It is a particular object to provide an apparatus which operates reliably even when the motor vehicle is subjected to extreme demands. If possible, measuring sensors already present within the motor vehicle are to be used in the regulation. It is yet another object of the invention to provide an apparatus which is relatively inexpensive.

These and other objects are attained, according to the invention, by providing a sensor for the indirect measurement of the average combustion chamber pressure fluctuations. This sensor is connected to an actual value generator which generates a signal which characterizes the fluctuation of the average combustion chamber pressure in two sequential time intervals. The actual value generator is connected to a first comparator for comparing the output signal of the actual value generator with a set point value formed from other operational parameters of the internal combustion engine. The first comparator is coupled with a servo-member which adjusts the fuel air mixture or, in another embodiment of the invention, changes the recycled exhaust gas quantity.

The invention will be better understood as well as other objects and advantages thereof will become more apparent from the ensuing detailed specification of five exemplary embodiments of the invention to be used in conjunction with the drawing.

BRIEF DESCRIPTION OF THE DRAWING

FIG. 11 is a pulse timing diagram to aid in the explanation of the exemplary embodiment according to FIG. 10;

FIG. 12 is an electric circuit diagram to be used in the description of the exemplary embodiment according to FIG. 10;

FIGS. 13–15 show different embodiments of sensor elements for the direct measurement of fluctuations in the average combustion chamber pressure; and FIG. 16 is a schematic diagram of a fifth embodiment of an apparatus according to the invention, for controlling the exhaust gas recycling process of an internal combustion engine.

DESCRIPTION OF THE PREFERRED EMBODIMENTS

The following descriptions relate to methods and apparatus by means of which an internal combustion engine may be operated, at least part of the time, in the operational domain adjacent to its lean running limit. The so-called lean running limit defines an operational domain in which there is a first occurrence of a retarded combustion process. (Complete combustion failure, i.e., a missing engine, occurs only when the mixture is considerably leaner than it is in this domain, namely when the air number $\lambda$ is 5% to 10% larger.) Within an operational domain so defined, the fuel consumption is, in general, substantially lower than within an operational domain of the engine in which its fuel-air mixture is stoichiometric, i.e., where the air number obeys $\lambda = 1$. In general, when the fuel-air mixture delivered to the internal combustion engine is leaned out, the turnover of the gases in the combustion chamber is slowed and the combustion of the fuel-air mixture is displaced from the region of the top dead center of the piston toward and into the expansion stroke of the piston. The cyclic fluctuations of the combustion process and hence those of the torque also increase, and if the load factor is nearly constant, the normally relatively regular fluctuations of the angular speed of the crankshaft become increasingly irregular.

Figure 1:
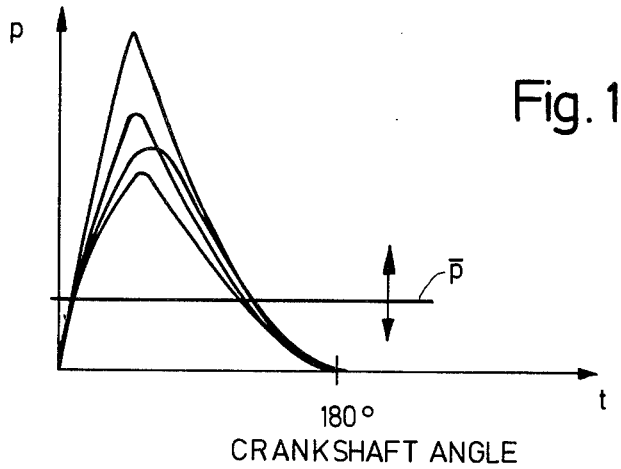
FIG. 1 is a schematic diagram which shows the pressure in one cylinder of the internal combustion engine as a function of time.
Figure 2:
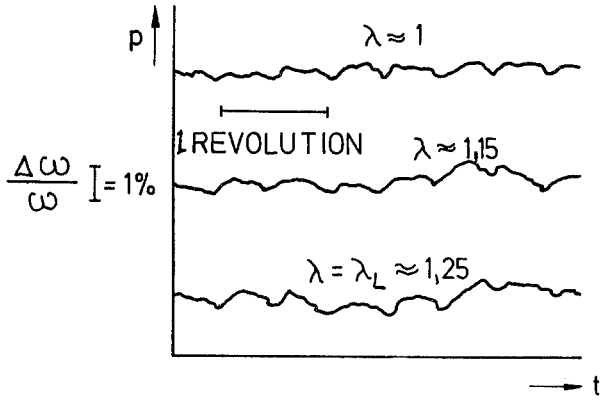
FIG. 2 is a diagram showing the changes in the angular speed of the engine in dependence on the concentration of the fuel-air mixture and as a function of time.
Figure 3:
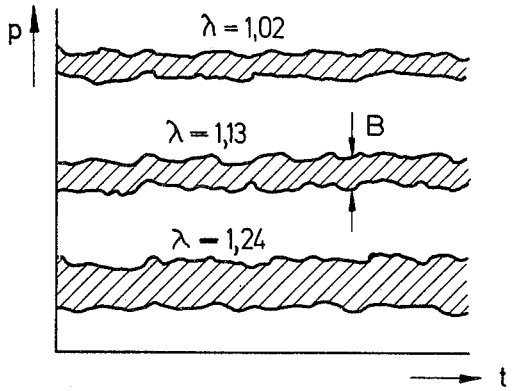
FIG. 3 is a diagram showing the superposition of a multitude of signals of the type shown in FIG. 2.

Turning now to the drawings, FIG. 1 is a diagram of the pressure in a cylinder of an internal combustion engine as a function of time. It may be seen that the pressure first increases, then attains a maximum and subsequently drops abruptly. This pressure is subject to a great deal of scattering which has an effect on the angular speed of the crankshaft of the engine. The curves show that a continuous measurement of the combustion chamber pressure would not be useful for a stable control of the fuel-air mixture and hence of the operational behavior of an internal combustion engine. However, if attention is confined to the pressure within an angular crankshaft region between 0° and 180°, and if the instantaneous values of the pressures are integrated, one obtains an average combustion chamber pressure which also varies in dependence on the composition of the fuel-air mixture. It is an object of this invention to exploit the dispersion or the scattering of the cyclic variations of this average combustion chamber pressure within predetermined time intervals in controlling the operational behavior of the internal combustion engine. Naturally, the most precise method for measuring the average combustion chamber pressure is to dispose a pressure sensor within the combustion chamber, but such measurements are extremely expensive. It is simpler, therefore, to monitor the variations of the torque at the crankshaft of the engine. It is still simpler to determine the changes in the angular speed of the engine or the changes in the time taken by the crankshaft to rotate through the angular distance between two predetermined angles. The conditions described above will now be elucidated with the aid of FIG. 2, in which the normalized change of the angular crankshaft speed is shown as a function of time and for several values of the fuel-air mixture. The top curve relates to an air number $\lambda = 1$, i.e., a stoichiometric mixture; the middle curve is related to an air number $\lambda = 1.15$; and the bottom curve is for an air number $\lambda = 1.25$. From these curves, it may be seen that the fluctuations of the angular speed of the crankshaft increase with an increasing air number, i.e., with an increasingly lean mixture. The diagram of FIG. 3 shows a superposition of several of the individual traces of FIG. 2, thus permitting the definition of a bandwidth B, as shown. Hence, to each value of $\lambda$ and of the fuel-air mixture, a particular width of the scattering in the angular speed may be pre-assigned and may be made dependent on the rpm and, for example, on the induction tube pressure. These predetermined values of the scattering bandwidth of the angular speed constitute a nominal command variable which may be used, together with the measured, actual value, to control the internal combustion engine to operate within the predetermined operational domain.

A control process of this sort has the particular advantage that "error parameters" such as fluctuating engine temperature, changes in the physical characteristics of the air used for combustion and of the fuel, as well as long-term changes in the engine, are automatically taken into account and do not require compensation.

Figures 4, 5:
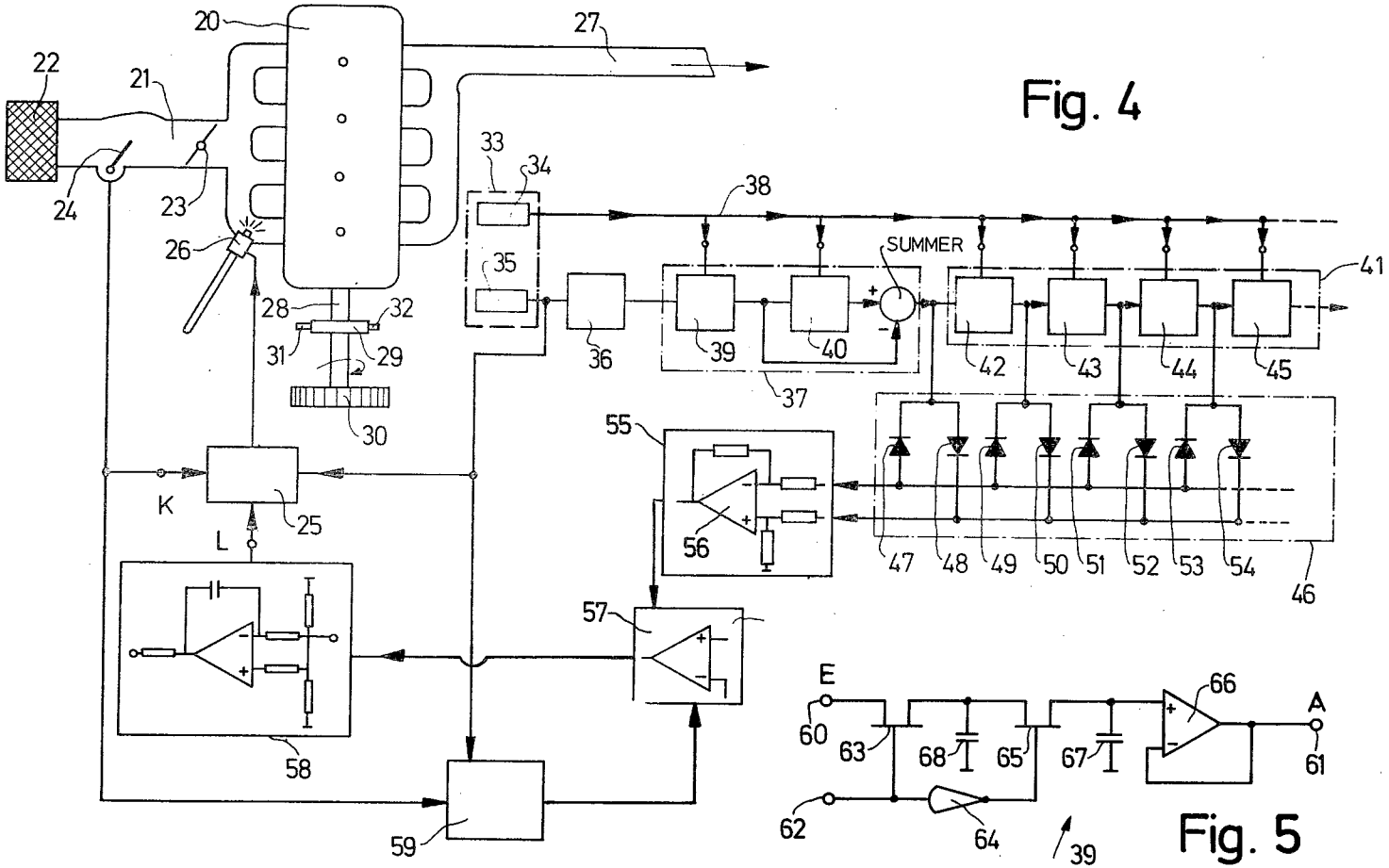
FIG. 4 is a schematic diagram of a first embodiment of an apparatus for influencing the fuel-air mixture in dependence on the fluctuations in the average combustion chamber pressure of the internal combustion engine.
FIG. 5 is a schematic circuit diagram of a storage circuit, used in the apparatus of FIG. 4.

FIG. 4 is a schematic diagram of an apparatus by means of which the duration of fuel injection in a fuel injection system may be changed in dependence on the scattering bandwidth of the fluctuations in the average combustion chamber pressure. In this first exemplary embodiment of the invention, an internal combustion engine 20 has an induction tube 21 and an air filter 22 which communicates with the outside atmospheric air. The induction tube 21 contains a throttle valve 23 of known function which is not further described. The induction tube 21 also contains a baffle plate 24 which is operatively associated with a fuel injection system 25. The air flow pivots the baffle plate 24; the greater the air flow rate, the greater the displacement and hence the greater the fuel quantity injected by an injection valve 26. Each of the induction tube fingers which, in the present example, are part of a four-cylinder internal combustion engine, contains an injection valve 26. An exhaust gas manifold 27 leads to an exhaust system (not shown) of the internal combustion engine.

The crankshaft of the engine 20 has an extension 28 on which are mounted two discs 29 and 30. The disc 29 has two markings 31 and 32 which define the crankshaft angles of 0° and 180°. The second disc 30 has circumferential serrations which may be used for measuring the rpm. The starter gear of the internal combustion engine 20 may serve as the disc 30.

Located opposite discs 29 and 30 is a sensor assembly 33 containing two individual sensors 34 and 35. These sensors may include oscillators, for example, whose coil is damped when the markings 31 and 32 or the serrations of the disc 30 pass by. Thus, the individual sensors 34 and 35 are capable of generating appropriate electrical signals.

The sensor 35 is connected to a pulse shaping stage 36 which is connected to an actual value signal generator 37 containing two storage circuits 39 and 40 whose construction will be explained in detail below with the aid of FIG. 5. The two storage circuits 39 and 40 have a common clock-line 38 fed by the sensor 35. The input signal to the second storage circuit 40 is compared to its output signal and the difference is stored in an analog shift register 41 with n locations. The exemplary embodiment depicted in FIG. 4 has four storage circuits 42, 43, 44 and 45, all of which are also connected to the common clock-line.

The inputs to the individual data storage circuits 42, 43, 44 and 45 are connected to a selector circuit 46 containing diodes 47–54. Diodes 47, 49, 51 and 53 having a common anode connection with the first input of an arithmetic circuit 55. The second input of the arithmetic circuit 55 is connected to the cathodes of diodes 48, 50, 52 and 54. The arithmetic circuit is a subtractor including an operational amplifier 56. The output of the arithmetic unit 55 carries the actual value of the controlled variable, namely the scattering bandwidth of the fluctuations in the angular speed. This actual value is fed to the input of a first comparator 57 whose second input is connected with a function generator 59 that forms a nominal value or set point. The nominal value may be determined, for example, from the engine rpm and from the air flow rate as measured by the baffle plate 24. The rpm-related signal is generated by the sensor 35 and is fed to the function generator 59. The first comparator feeds an integral controller 58 which engages the injection system 25 in the sense of increasing or reducing the fuel quantity.

The method of operation of the circuit described above is as follows:

The actual value of the scattering bandwidth B in FIG. 3 is formed by the sensor 33, the actual value generator 37, the analog shift register 41, the selector circuit 46 and the arithmetic unit 55. This value is compared with the nominal value of the scattering bandwidth $B_L$ formed by the function generator 59. The resulting signal is used to adjust the fuel injection system 25. The sensor 35 measures the instantaneous velocity of the crankshaft 28 of the engine 20 and the sensor 34 generates a signal which marks the starting time for the measuring process for determining a change in the average angular velocity during a working cycle of a piston. The output signal from the sensor 35 is fed to a pulse shaper 36 and then to the first storage circuit 39. When the clock-line 38 delivers a clock pulse, the value stored in the first storage circuit 39 is transferred to the second storage circuit and a new value of the instantaneous angular velocity is stored in the first storage circuit 39. The output signals from the first storage circuit 39 and from the second circuit 40 are substracted and the difference is stored in the analog shift register 41. For each pulse generated by the sensor 34 and delivered by the clock-line 38, this value is shifted by one location. The values stored in the analog shift register are fed to the selector circuit 46 which selects the largest and the smallest of the values stored in the analog shift register 41. These two values are subtracted from one another so that the output of the arithmetic unit 55 is the actual value that defines the bandwidth B of the cyclic fluctuations in the average combustion chamber pressure during predetermined time intervals, which, in this example, lie in the region between 0° and 180° and between 180° and 360° of the angle of rotation of the crankshaft. The actual value B is compared with the nominal value $B_L$ of the preselected scattering bandwidth and, depending on the magnitude of the output signal of the first comparator, the integral controller 58 controls the injection system 25 in the sense of increasing or decreasing the fuel quantity. For example, if the actual value is greater than the nominal value, more fuel is supplied and when the nominal value is greater than the actual value, less fuel is supplied. The integral controller 58 is provided in order to accommodate the deadtimes in the control loop which are associated with the combustion processes in internal combustion engine 20. It is possible to dispense with the integral controller 58, for example, in case the setting member which adjusts the fuel injection system has an inherent integral behavior, for example, if it is a servo-motor. In the present exemplary embodiment, the change in the fuel-air mixture is effected by influencing a fuel injection system. However, the fuel-air mixture may also be influenced by means of a servo-member acting on a carburetor of the internal conbustion engine.

FIG. 5 depicts one of the storage circuits 39, 40 and 42–45. Each storage has an input contact 60 which may be connected, as for example in the case of the first storage circuit 39, to the output of the pulse shaper 36. The storage circuit has an output contact 61 which, in the storage circuit 39, is connected to the second storage circuit 40. Finally, there is a second input contact 62 connected to the clock-line 38. The contact 60 is connected to the switching path of a first electronic switch 63, which, in the present exemplary embodiment, is a field effect transistor whose control electrode or gate is connected with the input contact 62. The control electrode is also connected through an inverting amplifier 64 to the control electrode of a second semi-conductor switch 65, which, in the present case, is also a field effect transistor. Connected in series with the second field effect transistor 65 is the non-inverting input of an operational amplifier 66 whose inverting input is connected to its own output. The non-inverting input of the operational amplifier 66 is also connected to a capacitor 67 whose other side is grounded. The connecting line between the two field effect transistors 63 and 65 is also grounded via a capacitor 68. The circuit described here is known per se as a "track and hold circuit," hence the function of this circuit will be described only briefly: If the clock input 62 carries a signal which makes the electronic switch 63 conducting, the capacitor 68 receives an rpm-dependent signal derived from the sensor 35 and the voltage on the capacitor 68 increases with increasing rpm. During this process, the switch 63 opens, for example, when the marking 31 passes the sensor 34 and it closes when the marking 32 passes it. While the electronic switch 63 is open, the electronic switch 65 is closed due to the presence of the inverting amplifier 64. On the other hand, if the electronic switch 63 is closed, then the electronic switch 65 is open, i.e., it becomes conducting when the marking 32 passes the sensor 34 and becomes non-conducting when the marking 31 passes. When the electronic switch 65 conducts, the value stored in the capacitor 68 is transferred to the capacitor 67 and stored there. At the same time, the output contact 61 carries an appropriate analog signal. During the next switching process, a new value delivered by the sensor 35 is stored in the capacitor 68 and is transferred to the capacitor 67 in the subsequent switching process. In this manner, it is possible to store electrically two subsequently occurring values and to compare them by means of the second storage circuit 40. This offers the advantage, in the exemplary embodiment according to FIG. 4, that the analog shift register does not have to store absolute values but only difference values, representing a considerable simplification of the circuit.

Figure 6:
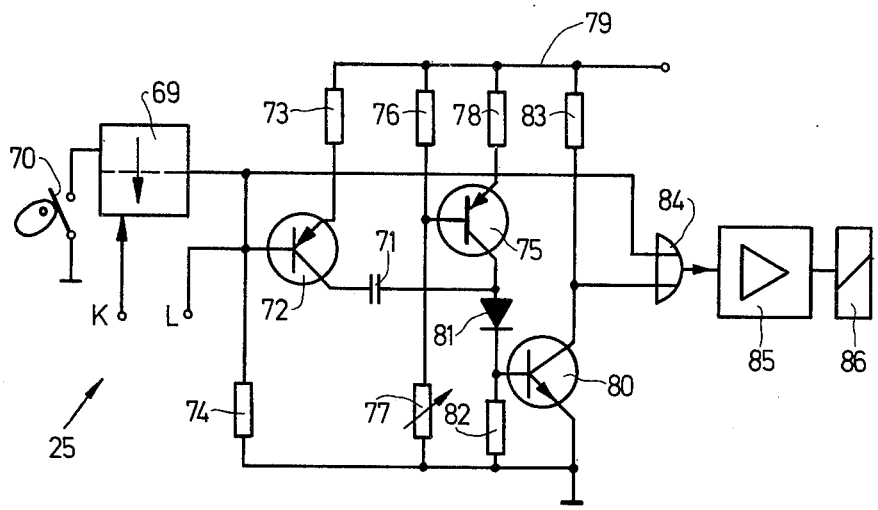
FIG. 6 is a schematic circuit diagram for an apparatus which determines the quantity of fuel injected into an internal combustion engine.

FIG. 6 is a more detailed illustration of fuel injection system 25 according to this invention. On the input side, this injection system contains a switching stage 69, which may be embodied, for example, as a monostable multivibrator. The monostable multivibrator 69 is controlled by a pulse generator 70 which is embodied here as a switch, actuated by a cam. The switch 70 is closed in synchronism with the rpm of the crankshaft so that each injection valve 26 receives an injection pulse during every second crankshaft revolution. The duration of the pulse generated by the monostable multivibrator 69 is changed in dependence on the measured air flow rate through the correction input K so that, when the air quantity is very large, more fuel is injected in order that the air number λ, describing the fuel-air mixture, may be kept constant.

Connected to the output of the monostable multivibrator 69 is a pulse extension stage containing a storage capacitor 71. One of the electrodes of the storage capacitor is connected to the collector of a transistor 72, whose emitter is connected to the positive terminal 79 through a resistor 73. The base of the transistor 72 is connected to the input contact L and is grounded through a resistor 74. Also connected to the input contact L is the output of the integral controller 58, depicted in FIG. 4. The second electrode of the storage capacitor 71 is connected to the collector of a discharge transistor 75 whose base is connected to a voltage divider comprising a resistor 76 and a variable resistor 77. The emitter of the discharge transistor 75 is connected to the positive terminal line 79 via a resistor 78. The collector of the discharge transistor 75 and the base of an inverting transistor 80 are connected together via a diode 81, whose polarity is such that it permits the flow of collector current for the discharge transistor 75. The base of the inverting transistor 80 is connected to ground through a resistor 82. A collector resistor 83 is connected between the collector of the inverting transistor 80 and the positive terminal line 79.

The output of the monostable multivibrator 69 and the collector of the inverting transistor 80 are connected, respectively, to the two inputs of an OR-Gate 84 which feeds into a control amplifier 85. The control amplifier 85 controls a magnetic winding 86 serving for actuation of the injection valve 26.

The method of operation of the above described fuel injection system 25 is known from similar, electronically controlled gasoline injection systems, for example from DT-AS 1 526 506 and hence it will only be described briefly: As already mentioned, the duration of the output pulses of the monostable multivibrator 69 is dependent on the air flow rate as measured with the aid of the baffle plate 24. The output pulse of the monostable multivibrator 69 is fed directly through the OR-gate 84 to the control amplifier 85. Directly behind this output pulse lies a continuation pulse or an extension pulse which is formed in the pulse extension stage containing the transistors 72 and 75. The duration of the extension pulse is proportional to the duration of the output pulse of the monostable multivibrator 69. The duration of the extension pulse is further influenced by the variable resistor 77, which may be, for example, an NTC-Resistor and may serve for measuring the engine temperature. Finally, the duration of the extension pulse may also be influenced by an arbitrary voltage supplied to the input contact L which controls the transistor 72 and hence controls the charging current of the capacitor 71 during the pulse from the monostable multivibrator 69. Thus, it also influences the amplitude of the voltage transition which is transmitted via the capacitor 71 at the termination of the output pulse of the monostable multivibrator 69. On the other hand, a change in the resistance of resistor 77 affects the discharge current of the capacitor 71 and hence alters the point of time at which the inverting transistor 80 again becomes conducting after being initially blocked. According to FIG. 4, the contact L is influenced by the integral controller 58 which, therefore, influences the duration of the extension pulse corresponding to the output signal of the first comparator 57, in the sense of increasing or decreasing the fuel quantity. The base electrodes of the two transistors 72 and 75 may be provided with further correcting voltages, so that, for example, a mixture enrichment may take place during the warmup phase of the internal combustion engine 20. In steady-state conditions, the inverting transistor 80 conducts. It is blocked when a negative pulse is transmitted from the storage capacitor 71. Hence the useful signal at the connector of transistor 80 is an L-type signal (a logical "1") just like the output signal of the monostable multivibrator 69, i.e., it is equal to the potential of the positive terminal line 79. The output of the OR gate 84 is a logical "1" when one of its inputs is a logical "1." Thus, the output pulse of the pulse extension stage is placed chronologically adjacent to the output pulse of the monostable multivibrator 69.

Figure 7:
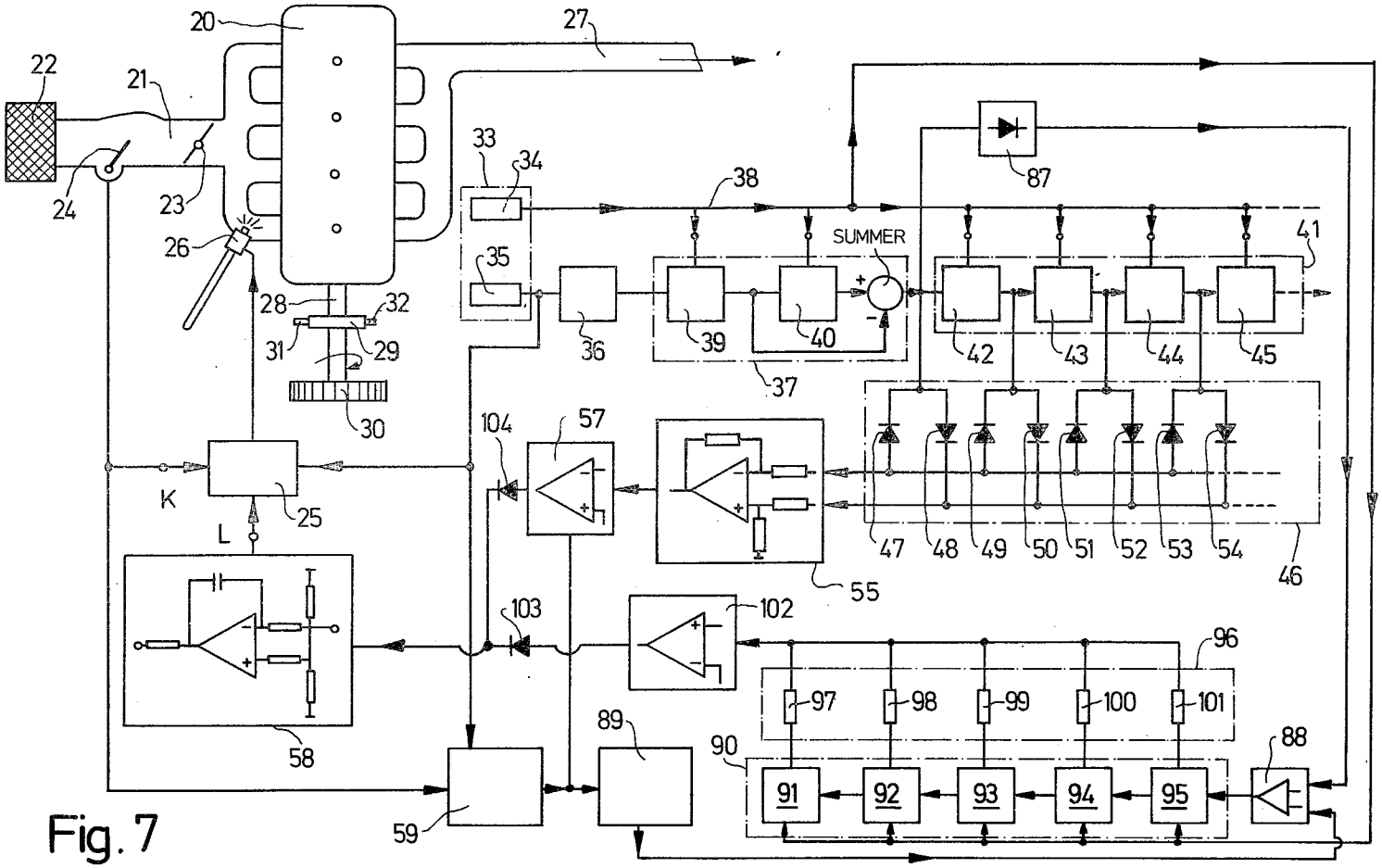
FIG. 7 is a schematic diagram of a second exemplary embodiment of an apparatus which determines the injected fuel quantity in dependence on the fluctuations of the average combustion chamber pressure of an internal combustion engine.

FIG. 7 depicts a further exemplary embodiment of an apparatus for controlling an internal combustion engine within a particular operational domain, especially in the domain of the lean running limit. It has been shown in tests, particularly at high rpm, that there are very often uni-directional changes in the angular speed of the crankshaft, i.e., the angular speed either increases or decreases during several engine cycles. This phenomenon can be suitably exploited to decrease the amount of time necessary for forming the actual value of the controlled variable which is to be stored as an analog value in the analog shift register 41.

For this purpose, an auxiliary circuit is added to the original apparatus depicted in FIg. 4, so that, when uni-directional deviations of the angular speed occur at the running limit of the engine or during accelerations, a rapid change of the correction variable is possible. As has already been mentioned, the circuit of FIG. 7 corresponds substantially to that of FIG. 4 and the same or similar parts retain the same reference numerals as in FIG. 4. In order to simplify the description and to avoid repetition, the description below will contain only the auxiliary circuit for determining uni-directional changes of the angular speed: Connected to the output of the actual value generator 37 is a full-wave rectifier 87 whose output is connected to the input of a second comparator 88. The second input of the second comparator is connected via a correction element 89 to the output of the function generator 59 which serves as the nominal value generator. The output of the second comparator 88 is fed to a digital shift register 90 which, in the present exemplary embodiment, has five storage locations 91–95. Such a digital shift register is generally known so that a more detailed explanation may be dispensed with. The outputs of the individual storage locations 91–95 are connected to a circuit 96 for the purpose of forming the average value of the output signals. This circuit for forming the average value includes resistors 97–101, joined at one end. The remaining ends are connected to the individual outputs of the storage locations 91–95, respectively. The common connection of resistors 97–101 is connected through an amplifier 102 and a diode 103 to the integral controller 58 which also receives the output of the first comparator 57 through a diode 104.

The operation of the above described auxiliary circuitry will now be elucidated:

The signals occurring at the output of the actual value generator 37 are rectified by the full-wave rectifier 87 and fed to the second comparator 88 where they are compared with a nominal value which may be changed by means of the correcting element 89. Whenever the actual value taken from the full-wave rectifier 87 exceeds the nominal value, then, for example, an L-type signal, i.e., a logical "1" is placed in storage. Conversely, if the actual value is smaller than the nominal value, a logical "0" is placed in storage. The circuit 96 forms the average value of the signals stored in the digital shift register 90 which is the larger, the greater is the number of L signals i.e., of logical "1"'s. This signal is amplified and fed through the diode 103 to the integral controller which engages the fuel injection system 25. In the present example, i.e., where a logical "1" occurs when the actual value is greater than the nominal value, the fuel injection system is influenced in the sense of a fuel enrichment, in order to reduce the fluctuations of the angular speed of the crankshaft. In the present case, the diodes 103 and 104 have the purpose of preventing mutual interaction between the first comparator 57 and the amplifier 102. The diode whose anode has the more positive signal is the one which conducts.

Figure 8:
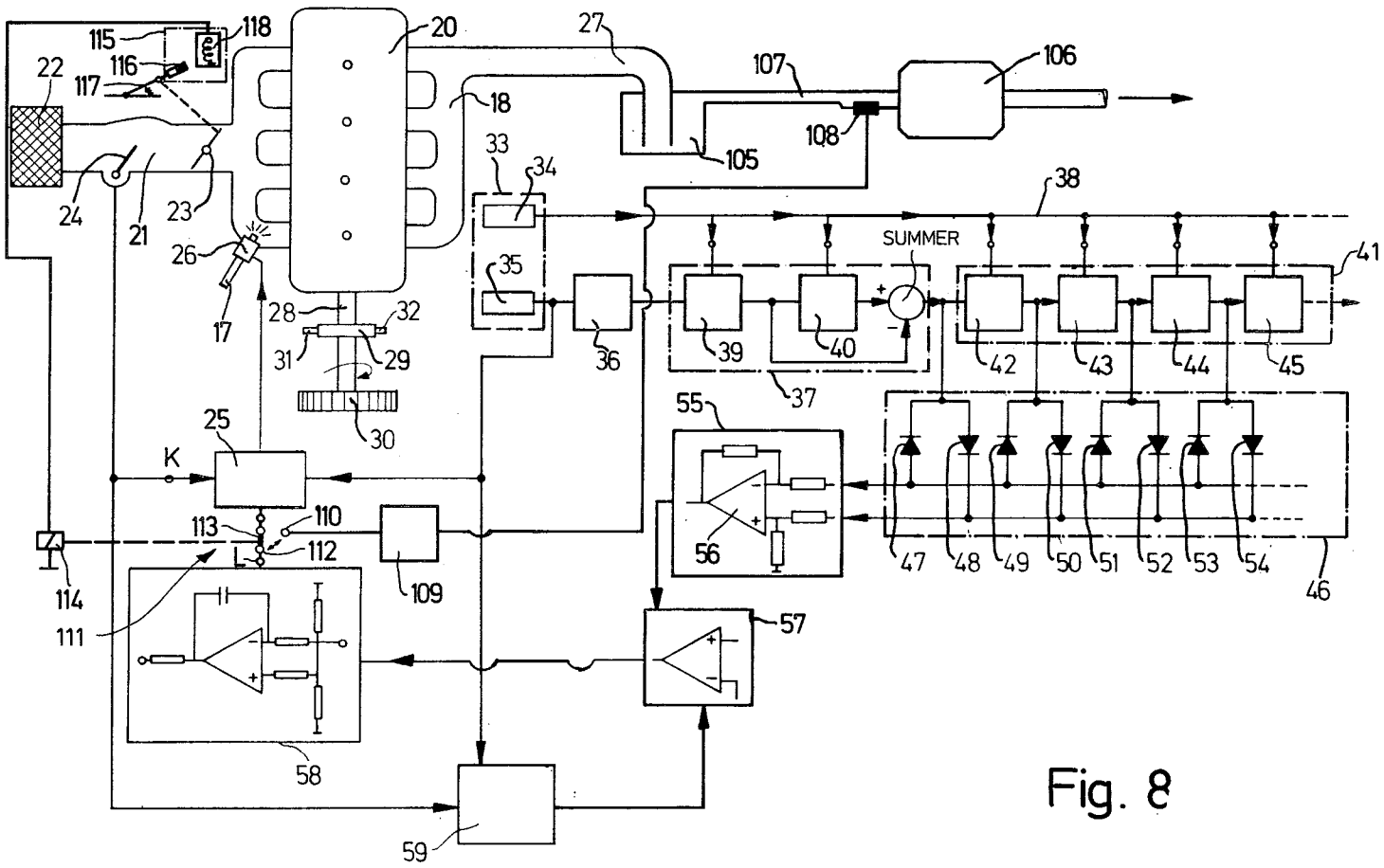
FIG. 8 is a schematic diagram of a third exemplary embodiment of an apparatus which influences the injection time in dependence on fluctuations of the average combustion chamber pressure or in dependence on the composition of the exhaust gas of the internal combustion engine.

A further (third) exemplary embodiment of an apparatus for controlling an internal combustion engine within a predetermined operational domain is illustrated in FIG. 8. In this example, it is particularly important to cease operating the engine in the domain of its lean running limit, for example, when high acceleration is demanded or when the engine is operated at low rpm, and either to run the engine in its basic mixture configuration or else to switch over to a control system which supplies a stoichiometric fuel-air mixture.

When the engine is subjected to high acceleration while being operated at its lean running limit, it may be difficult to distinguish the systematic change of the angular velocity of the crankshaft which occurs due to acceleration from the random changes in this angular velocity which constitute the controlled variable. It may be that, if a clear distinction becomes impossible for the controller, the fuel-air mixture is enriched at a predetermined rate which may mean that, when the acceleration continues for some time, the engine would be enriched beyond its rich running limit which is undesirable and should be prevented. Even in cases of acceleration or low rpm, the engine should deliver maximum torque in order to safeguard the operational reliability of the motor vehicle.

The exemplary embodiment according to FIG. 8 avoids the above cited difficulties by permitting a change-over from the lean running limit control process, which has been described in the exemplary cases illustrated by FIGS. 4 and 7, to a so-called λ control system known, for example, from the German Offenlegungsschrift 2 206 614. In principle, the apparatus according to FIG. 8 is the same as that according to FIG. 4, so that, to avoid repetition, only the newly added elements of the circuit will be explained. The exhaust manifold 27 leads to a thermal reactor 105 in which the carbon monoxide and hydrocarbons contained in the exhaust gases may be oxidized. Following the thermal reactor 105 is a catalytic reactor 106, connected by a connection line 107, wherein the nitrogen oxides contained in the exhaust gas are to be reduced. The connection line 107 contains a per se known oxygen sensor 108, whose output signal changes abruptly during a transition from a rich to a lean fuel-air mixture. This abrupt change of the output signal from the oxygen sensor which occurs when the air number λ crosses unity (1.0) can be used for controlling the internal combustion engine to operate in the operational domain of a stoichiometric fuel-air mixture. The oxygen sensor 108 is coupled to a λ-controller 109 which will be further described below with the aid of FIG. 9. The λ-controller 109 is coupled to the first contact 110 of a commutator 111. A second contact 112 of the commutator 111 is connected to the integral controller 58. The switching arm 113 of the commutator 111 is connected to the fuel injection system 25 so that either the integral controller 58 or the λ-controller 109 may be selectively connected to the fuel injection system 25. The switching arm 113 of the commutator 111 is actuated by a magnetic coil 114, which is coupled to an accelerometer 115. For example, the accelerometer may be a magnet 116 which is operatively associated with a gas pedal 117 of the internal combustion engine. This magnet 116 is moved past a coil 118 in which it induces a signal which depends on the rapidity with which the gas pedal 117 is depressed. If this signal is sufficiently large, the magnetic winding 114 is energized. As a result, for example during pronounced acceleration processes in which the gas pedal 117 is abruptly and rapidly depressed, there is a changeover from the control process at the lean running limit of the engine, governed by the integral controller 58 acting on the fuel injection system 25 to a λ-control process governed by the controller 109, so that satisfactory engine performance is obtained even during accelerations.

Figure 9:
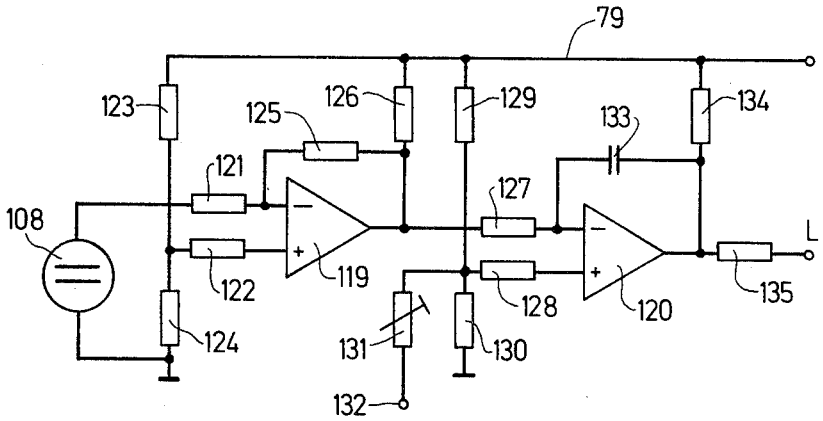
FIG. 9 is a schematic circuit diagram of an apparatus for sensing the composition of the exhaust gas of an internal combustion engine.

FIG. 9 is a detailed schematic diagram of the λ-controller 109. This controller includes a first operational amplifier 119 which provides proportional amplification of the output signal from the oxygen sensor 108 and it includes a second operational amplifier 120, wired as an integral controller. One electrode of the oxygen measuring sensor 108 is connected through an input resistor 121 to the inverting input of the operational amplifier 119 and its other electrode is grounded. The non-inverting input of the operational amplifier 109 is connected via an input resistor 122 to the junction of two resistors 123 and 124, constituting a voltage divider. Connected between the output and the inverting input of the operational amplifier 119 is a feedback resistor 125 whose magnitude determines the amplification factor. The output of the operational amplifier 119 is also connected through a resistor 126 to the positive terminal line 79 which leads to a storage battery (not shown) of the motor vehicle.

The output of the operational amplifier 119 is fed through an input resistor 127 to the inverting input of the operational amplifier 120. The non-inverting input of the operational amplifier 120 is connected through a resistor 128 to the junction of two resistors, 129 and 130, constituting a voltage dividing circuit. The tap of this voltage divider is also connected through a variable resistor 131 to the input contact 132. The feedback loop of the operational amplifier 120 includes an integrating capacitor 133, connected between the output and the inverting input. Finally, the output of the operational amplifier 120 is connected through a resistor 134 to the positive terminal line 79 and through a resistor 135 to a contact L which is identical with the contact L shown in FIGS. 5, 6, 7 and 8.

The mutual cooperation of the λ-controller 109 according to FIG. 9 with the fuel injection system 25 according to FIG. 6 is also known and will only be described briefly:

To aid in the description of a particular operational state, let it be assumed, for example, that the duration of the output pulse from the fuel injection system is a little too long. This means that too much fuel is being injected and the mixture is too rich. When the fuel-air mixture is rich, i.e., when the air number λ is less than 1, the oxygen sensor produces a relatively high output potential.

The output potential of the oxygen sensor 108 is amplified in the operational amplifier 119. Since this amplifier acts as an inverting amplifier, the output potential becomes negative and is fed through the input resistor 127 to the inverting input of the operational amplifier 120. This amplifier is wired as an integrator and thus integrates in the positive direction when its input voltage is negative. Thus, the potential at the output L becomes slowly more positive. The more positive the potential at the point L, the smaller is the charging current for the capacitor 71 which flows through the transistor 72. (See FIG. 6) Thus, the duration of the pulse from the pulse extension stage in the fuel injection system 25 is shortened, so that the output pulse from the pulse extension stage, which is attached by the OR-gate 84 to the output pulse of the monostable multivibrator 69, is also shortened. Therefore, the magnetic winding 86 is excited for a shorter time and less fuel is injected. As a result, the fuel-air mixture is made leaner until the air number λ is equal to 1.0. At that moment, the output potential of the oxygen sensor 108 drops abruptly, and the operational amplifier 120 begins to integrate in the opposite, i.e., the negative, direction so that the duration of the output pulses delivered by the pulse extension stage is increased again.

Figure 10:
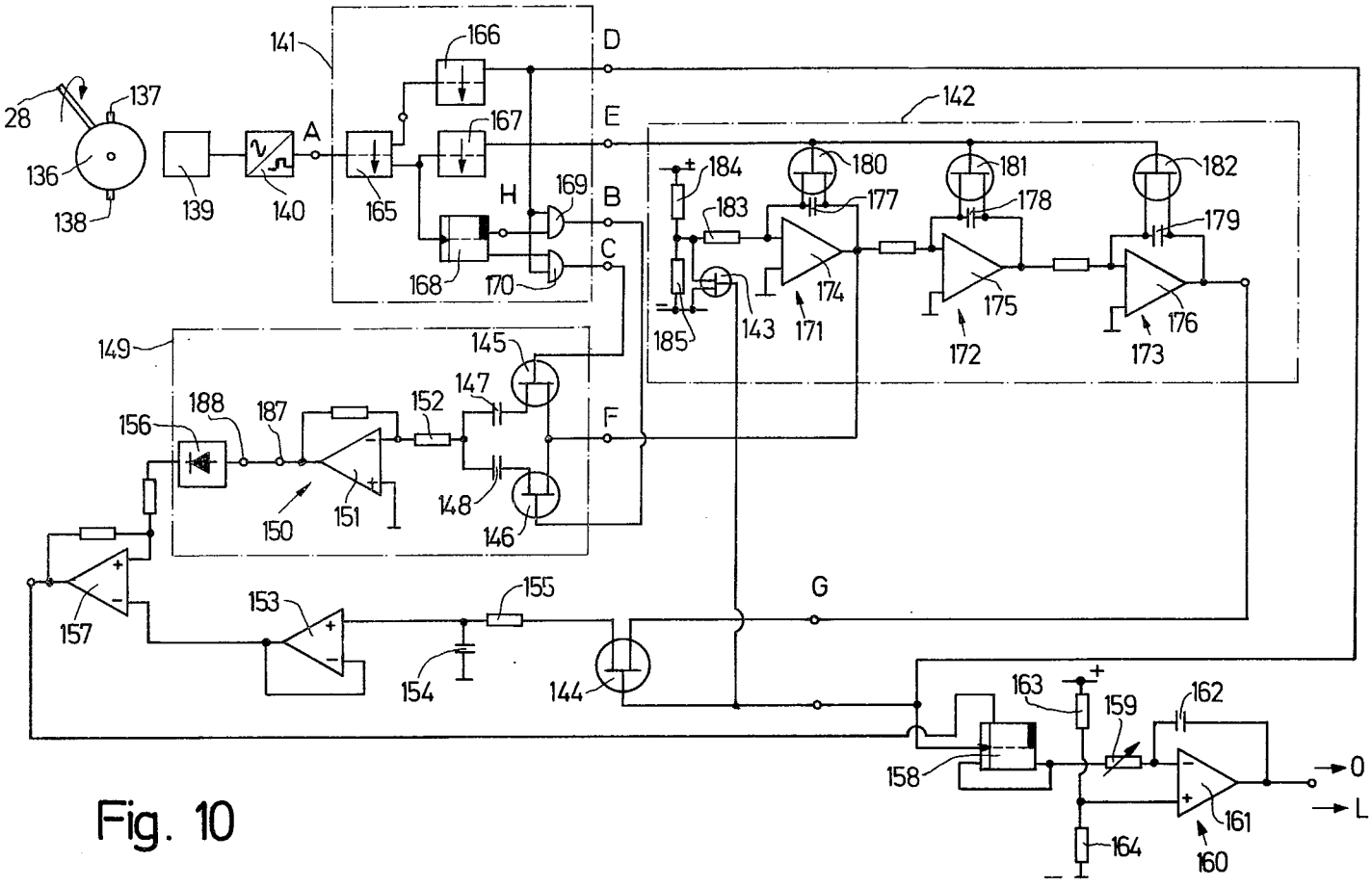
FIG. 10 is a schematic diagram of a fourth exemplary embodiment of an apparatus for influencing the fuel-air mixture delivered to the internal combustion engine, in dependence on the fluctuations of the average combustion chamber pressure.

A further (fourth) exemplary embodiment for controlling an internal combustion engine in a particular operational domain is illustrated in FIG. 10. This installation also permits controlling an internal combustion engine in the domain of its lean running limit which normally means that the fuel-air mixture is approximately 25% leaner than during the basic configuration of the internal combustion engine. In the control system according to FIG. 10, the controlled variable is the fluctuation of the time taken by the crankshaft to rotate through a particular angle, in the present case 180°, and these times are inversely proportional to the average angular speed over a crankshaft angle of 180°. The mechanism for measuring the time of rotation is a disc 136, disposed on the crankshaft 28 of the internal combustion engine. The disc 136 has two markings 137 and 138, which move past a sensor 139. The sensor is connected to a pulse shaper 140 for forming rectangular pulses. An output contact A of the pulse shaper is connected to a controller 141 which has output contacts B, C, D and E. The output contact E is connected to a nominal value generator 142, embodied here as a function generator. The output contact D of the controller 141 actuates two semiconductor switches 143 and 144, the semiconductor switch 143 belonging to the nominal value generator 142. The output contacts C and B of the of the controller 141 are connected to the control electrodes of semiconductor switches 145 and 146, respectively. The switches 145 and 146 lie in series with storage elements 147 and 148, respectively, and belong to an actual value generator 149. This actual value generator 149 includes an alternating current amplifier 150, embodied as an operational amplifier 151, whose inverting input is connected via a resistor 152 to the junction of the two storage elements 147 and 148. The output of the operational amplifier 151 is fed through a full-wave rectifier 156 to the first input of a first comparator 157 whose second input receives the output from an amplifier 153. This amplifier 153 receives its signal from the nominal value generator 142 after passage through an electronic switch 144 and a resistor 155. A grounded storage element 154 is also connected to the second input of the amplifier 153. The output of the first comparator 157 is fed to the first input of a bistable multivibrator 158, whose clock input is connected to the contact D of the control circuit 141. The output from the bistable multivibrator 158 is connected, firstly, to its own second input and, secondly, through an adjustable resistor 159 to an integral controller 160 which is embodied as an operational amplifier 161 and includes an integrating capacitor 162 between its output and its inverting input. The non-inverting input of the operational amplifier 161 is provided with a reference voltage which is tapped at the junction of two resistors 163 and 164 which form a voltage divider.

The control circuit 141 includes a first monostable multivibrator 165 whose input is connected to the input contact A. A first output of the monostable multivibrator 165 is connected to the input of a second monostable multivibrator 166 whose output is connected to the output contact D of the control circuit 141. A second output of the first monostable multivibrator is connected to the input of a third monostable multivibrator 167 whose output goes to the contact E. Finally, the second output of the first monostable multivibrator 165 is connected to the clock input of a bistable multivibrator 168, whose first output is connected to the first input of a first AND-gate 169. The second output of the bistable multivibrator 168 is connected to a first input of a second AND-gate 170. This second inputs of the AND-gates 169 and 170 are both connected to the output of the second monostable multivibrator 166. The output of the first AND-gate 169 is fed to the output contact B of the control circuit 141 and the output of the second AND-gate 170 goes to the output contact C. The output contact B is connected to the control electrode of the semiconductor switch 146 and the output contact C is connected to the control electrode of the semiconductor switch 145. An output of the nominal value generator 142 is connected to the contact F of the actual value generator 149 and hence leads to the switching paths of both of the semiconductor switches 145 and 146.

The nominal value generator 142 includes three integrators 171, 172 and 173 which include operational amplifiers 174, 175 and 176. Each of their outputs is connected back to one of their inputs via integrating capacitors 177, 178 and 179, respectively. Connected in parallel to each of the integrating capacitors are semiconductor switches 180, 181 and 182, respectively, the control electrodes of which are joined to the output contact E of the control circuit 141. The first input of the operational amplifier 174 is connected through an input resistor 183 to the junction of resistors 184 and 184 which form a voltage divider. The resistor 185 may be shorted by the semiconductor switch 143, the control electrode of which is connected to the output contact D of the control circuit 141. The output of the third operational amplifier 176 goes to the output contact G and also represents the output of the nominal value generator. As mentioned above, this output is connected to the semiconductor switch 144. In this exemplary embodiment, according to FIG. 10, the semiconductor switches are field effect transistors.

The method of operation of the exemplary embodiment according to FIG. 10 will now be described with the aid of the timing diagrams in FIG. 11: When the markings 137 or 138 of the disc 136 move past the sensor 139, the latter generates an electrical signal which is transformed into a rectangular pulse with the aid of the pulse shaper 140. The sequence of rectangular pulses generated by the pulse shaper 140 appears at the input A of the control circuit 141 and triggers the first monostable multivibrator 165 which generates the pulse 186 in the trace M of FIG. 11. The monostable multivibrator 165 uses the pulses appearing at contact A, which may have differing duration, and generates corresponding pulses with constant duration. When the first monostable multivibrator switches into its unstable state, it triggers the second monostable multivibrator 166, which also switches over into its unstable state. At the output of the second monostable multivibrator 166 appears the sequence of pulses shown in the trace D of FIG. 11. When the first monostable multivibrator 165 switches back to its stable state, i.e., during the negative-going transition of the pulses shown in trace M of FIG. 11, the third monostable multivibrator 167 is triggered, resulting in the sequence of pulses shown in trace E of FIG. 11 which appears at the contact E of the control circuit 141. The negative-going transition of the pulses shown in the trace M of FIG. 11 also switches the bistable multivibrator 168. Output H carries the sequence of pulses shown in trace H of FIG. 11. Thus, depending on the switching state of the bistable multivibrator, whenever a pulse appears at the output contact D, an output pulse appears alternately at the output contacts B or C. Hence, the bistable multivibrator 168, in combination with the AND-gates 169 and 170, acts as a 2:1 frequency divider. The output pulses which appear at the contact E of the control circuit 141 are fed to the control electrodes of the semiconductor switches 180, 181 and 182 which short-circuit and, therefore, discharge the integrating capacitors 177, 178 and 179 of the nominal value generator 142 whenever a pulse appears at the output contact E.

In the present case, as has already been mentioned above, the nominal value generator 142 is intended to form an rpm-dependent nominal value. It is possible to consider other engine parameters such as induction tube pressure, cooling water temperature, etc., in the formation of the nominal value. It has been shown that the nominal value of the fluctuations of the angular traversal time $\Delta T_{nom}$ is proportional to $T^3$ when the average pressure fluctuations in the operating cylinders of the engine are constant, where T is the average time for the crankshaft to rotate through the angle $\alpha$. Since $T^3$ is proportional to $n^3$ where n is the rpm, the nominal value generator must generate an electrical signal which has characteristics similar to those depicted in trace G of FIG. 11.

As may be inferred from trace G of FIG. 11, the voltage increases cubically between two pulses triggered by the markings 137 and 138, respectively. This voltage is formed by triple integration of the voltage at the first input of the operational amplifier 174 which is formed by the voltage divider 184, 185. The integration process is initiated by the pulse which appears at the output contact D of the control circuit 141 and which causes the semiconductor switch 143 to conduct, thereby making the voltage at the input of the first operational amplifier O for a short period of time. After the pulse at the output contact D has decayed and, thus, the semiconductor switch 143 is blocked again, the voltage appearing at the output of the operational amplifier 174 increases according to the curve shown in trace F of FIG. 11. This voltage is fed to the second operational amplifier 175 and also to the contact F which is connected to the actual value generator 149. When the semiconductor switches 145 and 146 alternately conduct due to the occurrence of pulses at contacts C and B, respectively, the output of the first integrator 171 which appears at the contact F is delivered to the storage element 147 or 148, respectively. This is done in order to compare two measured values, which, in the present case, are the traversal times which have been determined with respect to equal rotational angles of the crankshaft. In the case of a six-cylinder engine, this would require, for example, three storage locations.

The voltage which appears at the junction of the two storage elements 147 and 148 has a direct current component which is equal to the average traversal time of the crankshaft over a predetermined angular path, i.e., it is equal to the average period T of the pulses appearing at the contact A. The voltage appearing at the junction of the storage elements 147 and 148 also has an alternating current component whose amplitude is proportional to the fluctuations in the period of the pulse sequence, i.e., it is proportional to the fluctuations in the traversal time. This is the desired actual value for the control process.

The peak values occurring at the output contact G of the nominal value generator 142 are stored in a third storage element 154 under the control of the pulses appearing at the output contact D of the control circuit 141: the voltage at the output contact G is transferred whenever the semiconductor switch 144 is made conducting by the output pulses appearing at the contact D. The measured value stored in the third storage element 154 is the nominal desired value of the controlled variable. The first comparator 157 compares the nominal value with the actual value and its output delivers short pulses whenever the actual value is greater than the nominal value. When the actual value is smaller than the nominal value, no pulses appear at the output of the first comparator 157. The output of the first comparator is connected to the set-input of the bistable multivibrator 158 and, whenever pulses appear at the output of the first comparator, they set the bistable multivibrator 158 into a condition in which an L signal, i.e., a logical "1" appears at the output of the bistable multivibrator 158. On the other hand, for each clock pulse appearing at the contact D of the control circuit 141, the bistable multivibrator 158 switches into a condition in which its output carries a logical "0."

When the actual value is smaller than the nominal value, the output of the first comparator, as had already been described above, carries a constant logical "0." This means that no pulse reaches the set-input of the bistable multivibrator 158. As a consequence, its output carries a logical "0" and the integrator 160 integrates in the positive sense, i.e., the output voltage of the operational amplifier 161 increases and this voltage increases the actual value toward the nominal value.

Conversely, if the actual value is greater than the nominal value, the output of the first comparator delivers a sequence of pulses. These pulses switch the bistable multivibrator 158 into a position in which its output carries a logical "0." However, the pulses appearing at the set-input of the bistable multivibrator 158 switch the multivibrator back so that its output carries a logical "1," the effect of which is that the output signal of the operational amplifier 161 changes in the direction of O. The clock pulse which appears at the contact D of the control circuit 141 returns the bistable multivibrator 158 into its preferred condition, in which its output again carries the logical "0" signal. The exemplary embodiment, according to FIG. 10, also offers the possibility to switch over to the basic configuration of the fuel-air mixture preparation system or to a λ-controller when very high accelerations are demanded, so that the maximum torque of the internal combustion engine may be attained. This switchover process occurs, according to the exemplary embodiments illustrated in FIG. 8, for example, by using an accelerometer corresponding to that labeled 115. Any desired sensor may be used instead of this accelerometer, for example, a per se known throttle valve switch.

FIG. 12 depicts a circuit which permits using the controller according to FIG. 10, even during a rapid acceleration of the internal combustion engine. FIG. 12 depicts a portion of a circuit which would be connected between the two contacts 187 and 188 of the exemplary embodiment according to FIG. 10. These contacts 187 and 188 are also shown in FIG. 12 and the circuit shown therein further includes contacts 189 and 190, connected, respectively, with the contacts A and D of the control circuit 141 in FIG. 10. The contact 187 in FIG. 12 leads to an integrator 191 formed by an operational amplifier 191, an integrating capacitor 193 and an input resistor 194. Connected in parallel with the integrating capacitor 193 is the conducting path of a semiconductor switch 195 which can short-circuit the integrating capacitor and hence reduce its potential to zero. The control electrode of the semiconductor switch 195 is connected to the contact 189. Connected to the output of the operational amplifier 192 is the switching path of a semiconductor switch 196, whose control electrode is connected to a monostable multivibrator 197, controlled by the contact 190. Following the semiconductor switch 196 is an alternating current amplifier 198, comprising an operational amplifier 199, a feed back resistor 200, an input resistor 201 and an input capacitor 202 in series with the input resistor 201.

The method of operation of the above described circuit is as follows:

Appearing at the contact 187 is an alternating potential whose amplitude is proportional to the fluctuations of the rotational traversal times of the crankshaft. This potential is integrated by the integrator 191 and produces a potential corresponding to the pulse height. This potential, in turn, is proportional to the engine acceleration, i.e., when the acceleration of the engine is constant, this potential is also constant. Thus changes in this potential only depend on a random scattering of the rotational traversal times of the engine and do not depend on any changes of the rotation time which are due to an acceleration of the engine. When the semiconductor switch 196 is closed by the monostable multivibrator 197, then the voltage appearing at the output of the operational amplifier 192 is transmitted to an alternating current amplifier and thence to the contact 188. The apparatus described here permits a control process in the operational domain of the lean running limit of the engine even during rapid acceleration.

FIGS. 13 to 15 show different embodiments of sensors which may be used, for example, in measuring the changes of the average angular speed, or the angular rotational traversal times of the crankshaft. The sensor according to FIG. 13, which has the disc 29 and the markings 31 and 32 is suitable for measuring the average angular speed over predetermined crankshaft angles, in this case over 180°, i.e., in a four-cylinder engine. In FIG. 13, the average angular speed is measured once between passage of the markings 31 and 32 and again in the subsequent region occurring between passage of the markings 32 and 31. These regions are defined with respect to the passage of the markings in front of a coil 203.

Due to manufacturing tolerances, for example, the angular distance between the two markings 31 and 32 may not be identical with the angular distance in the reverse sense, i.e., between markings 32 and 31. Hence it is useful to employ the same angular region for each measurement, i.e., for example, the sensor according to FIG. 13 may determine the average angular speed between the markings 31 and 32 and the next measured value is taken after a complete revolution of the disc 29, again between the passage of the markings 31 and 32. This means that the region between the markings 32 and 31 is not used and that only one measured value is obtained per revolution of the crankshaft.

FIG. 14 is a diagram which illustrates how the same apparatus may be used to obtain two measured values for each crankshaft revolution. The disc 29 again has the two markings 31 and 32 which are moved past the coil 203. If the average angular speed is measured over a complete crankshaft revolution, i.e., from a first passage of the marking 31 up to a second passage of the marking 31 and, at the same time, one obtains the average angular speed in a region defined by a first passage of the marking 32 and a second passage of the marking 32, then one has two items of information for each revolution of the crankshaft and these measured values are obtained over identical angular regions.

Finally, FIG. 15 illustrates a disc 204 which is mounted on the crankshaft 28 of the internal combustion engine 20 and which has markings 205–210. This mechanism is suitable for measuring the time of passage in the regions between the markings 205 and 206, between the markings 207 and 208 and between the markings 209 and 210 during a passage in front of the coil 211. The tripartite system is suitable for a six-cylinder engine, in which a one-third revolution of the crankshaft is associated with one complete operating stroke of the piston of the internal combustion engine.

In the various exemplary embodiments described above, it was assumed that the output of the first electric comparator is operationally coupled into a fuel injection system or the carburetor of an internal combustion engine, so that the fuel preparation of the internal combustion engine may be regulated within a particular operational domain. A further possibility to control the engine in a particular operational domain is represented by FIG. 16. This figure, again, shows the internal combustion engine 20 in greatly simplified form. The exhaust gas manifold 27 communicates back with the induction tube 21 through an exhaust gas recycle line 212. The recycle line 212 contains a valve 213 which determines the quantity of exhaust gas which is recycled. The further the valve 213 is opened, the greater is the quantity of recycled exhaust gas, whereas a closure of this valve 213 reduces the recycled exhaust gas quantity. The valve 213 is actuated by a servo-motor 214 which has integral operational behavior and which is controlled by the first comparator 57 in the exemplary embodiments of FIG. 4, 7, 8 or 10. In that case, the internal combustion engine 20 may be regulated within a particular operational domain in that the recycled exhaust gas quantity is changed by adjusting the valve 213. If, for example, the internal combustion engine is operated near its lean running limit, then, if the scattering of the fluctuations in the average pressure of the engine and hence the fluctuations of the angular speed were to increase beyond the desired nominal value, then the recycled exhaust gas quantity would be increased, whereas, if the scattering bandwidth of the fluctuations of the average combustion chamber pressure and hence also the fluctuations of the angular speed of the crankshaft are below the desired nominal value, then the recycled exhaust gas quantity is increased. The basic control systems described for the exemplary embodiments of FIG. 4, 7, 8 or 10 do not change, in principle, when used in the exemplary embodiment of FIG. 16.

What is claimed is:

1. An apparatus for controlling the operation of an internal combustion engine, which includes a crankshaft, comprising:

(A) sensor means associated with the crankshaft, for sensing crankshaft rotation during a predetermined measurement-time interval and forming an electrical signal related to the crankshaft rotation, said measurement-time interval corresponding to an angular region of the crankshaft rotation related to at least one stroke of a piston of the engine;

(B) actual value signal generator means including integration means, connected to said sensor means, for integrating sequential ones of the electrical signals generated by the sensor means generating during the predetermined measurement-time interval an electrical actual value signal related to the speed of rotation of the crankshaft, which signal is representative of the fluctuation in the average combustion chamber pressure in two sequential time intervals;

(C) nominal value signal generator means, for generating an electrical nominal value signal from engine parameters;

(D) first comparator means, for electrically comparing said actual value signal with said nominal value signal and for forming an electrical output signal; and (E) servo means, connected to the output of said first comparator means, for adjusting the composition of the fuel-air mixture of said internal combustion engine in response to the electrical output signal.

2. An apparatus for controlling the operation of an internal combustion engine, which includes rotating drive means comprising:

(A) sensor means, associated with said rotating drive means, for forming an electrical signal related to the rotation of said rotating drive means, which rotation is related to the combustion chamber mean pressure;

(B) actual value signal generator means, connected to said sensor means, for generating an electrical actual value signal related to the speed of rotation of said rotating drive means;

(C) nominal value signal generator means for generating an electrical nominal value signal from engine parameters;

(D) first comparator means for electrically comparing said actual value signal with said nominal value signal and for forming an electrical output signal;

(E) servo means, connected to the output of said first comparator means, for adjusting the composition of the fuel-air mixture of said internal combustion engine;

(F) a first shift register, for storing sequential ones of said electrical actual value signals;

(G) a selector circuit, for selecting the smallest and the largest of said signals stored in said first shift register; and (H) an arithmetic circuit, connected to the output of said selector circuit, for forming a signal representative of the difference between said largest and said smallest of the signals stored in said first shift register, wherein said actual value signal generator means includes at least two data storage locations and said electrical actual value signal is representative of the fluctuations in the average combustion chamber pressure in two sequential time intervals.

3. An apparatus for controlling the operation of an internal combustion engine, which includes rotating drive means comprising:

(A) sensor means, associated with said rotating drive means, for forming an electrical signal related to the rotation of said rotating drive means, which rotation is related to the combustion chamber mean pressure;

(B) actual value signal generator means, connected to said sensor means, for generating an electrical actual value signal related to the speed of rotation of said rotating drive means;

(C) nominal value signal generator means for generating an electrical nominal value signal from engine parameters;

(D) first comparator means, for electrically comparing said actual value signal with said nominal value signal and for forming an electrical output signal;

(E) servo means, connected to the output of said first comparator means, for adjusting the composition of the fuel-air mixture of said internal combustion engine;

(F) electrical rectifying means, connected to the output of said actual value signal generator, for rectifying the signals thereof;

(G) second comparator means, whose first input receives the output of said rectifying means and whose second input receives signals from said nominal value signal generator means;

(H) a second shift register which receives signals from said second comparator means;

(I) circuit means for forming an electrical average of signals received from said second shift register; and (J) diode means, connected between said circuit means and said servo means.

4. An apparatus for controlling the operation of an internal combustion engine, which includes rotating drive means comprising:

(A) sensor means, associated with said rotating drive means, for forming an electrical signal related to the rotation of said rotating drive means, which rotation is related to the combustion chamber mean pressure;

(B) actual value signal generator means, connected to said sensor means, for generating an electrical actual value signal related to the speed of rotation of said rotating device means;

(C) nominal value signal generator means for generating an electrical nominal value signal from engine parameters;

(D) first comparator means, for electrically comparing said actual value signal with said nominal value signal and for forming an electrical output signal;

(E) servo means, connected to the output of said first comparator means, for adjusting the composition of the fuel-air mixture of said internal combustion engine;

(F) pulse train generator means to receive signals from said sensor means and adapted to deliver signals to said nominal value signal generator for forming rmp-related nominal value signals and also connected to deliver signals to said actual value generator means;

(G) first AC amplifier means, for amplifying signals from said at least two data storage locations;

(H) rectifying means between said first AC amplifier means and said first comparator means, said first comparator means also being arranged to receive signals from said nominal value signal generator means; and (I) a bistable multivibrator whose first input is arranged to receive signals from said first comparator means, the second input of which is connected to its own output, with the clock input arranged to receive signals from said pulse train generator means and the output of which is arranged to operate said servo means, wherein said actual value signal generator means includes at least two data storage locations.

5. An apparatus for controlling the operation of an internal combustion engine, which includes rotating drive means comprising:

(A) sensor means, associated with said rotating drive means, for forming an electrical signal related to the rotation of said rotating drive means, which rotation is related to the combustion chamber mean pressure;

(B) actual value signal generator means, connected to said sensor means, for generating an electrical actual value signal related to the speed of rotation of said rotating drive means;

(C) nominal value signal generator means for generating an electrical nominal value signal from engine parameters;

(D) first comparator means, for electrically comparing said actual value signal with said nominal value signal and for forming an electrical output signal; and (E) servo means, connected to the output of said first comparator means, for adjusting the composition of the fuel-air mixture of said internal combustion engine, wherein said nominal value signal generator includes three electrical integrating circuits, disposed in series, for forming a signal which is proportional to the inverse third power of the rpm of the engine and constitutes a nominal value of the rotation time of said rotating drive means.

6. An apparatus for controlling the operation of an internal combustion engine, which includes rotating drive means comprising:

(A) sensor means, associated with said rotating drive means, for forming an electrical signal related to the rotation of said rotating drive means, which rotation is related to the combustion chamber means pressure;

(B) actual value signal generator means, connected to said sensor means, for generating an electrical actual value signal related to the speed of rotation of said rotating drive means, said actual value signal generator means includes at least two data storage locations;

(C) nominal value signal generator means for generating an electrical nominal value signal from engine parameters;

(D) first comparator means, for electrically comparing said actual value signal with said nominal value signal and for forming an electrical output signal;

(E) servo means, connected to the output of said first comparator means, for adjusting the composition of the fuel-air mixture of said internal combustion engine;

(F) pulse train generator means to receive signals from said sensor means and adapted to deliver signals to said nominal value signal generator for forming rpm-related nominal value signals and also connected to deliver signals to said actual value generator means;

(G) first AC amplifier means, for amplifying signals from said at least two data storage locations; and (H) rectifying means between said first AC amplifier means and said first comparator means, said first comparator means also being arranged to receive signals from said nominal value signal generator means.

7. A method for controlling the operation of an internal combustion engine, comprising the steps of:

(A) determining a measurement-time interval, the duration of which corresponds to an angular region of the crankshaft rotation related to at least one stroke of a piston of the engine;

(B) generating a measurement value from an engine operating parameter during the measurement-time interval, said generated measurement value varying during the measurement-time interval as a measure of the fluctuations of the angular speed of the crankshaft over said angular region, and corresponding to the average combustion chamber pressure;

(C) integrating the measurement value generated;

(D) comparing an integrated measurement value generated during a subsequent measurement-time interval and generating a differential value as an actual value of the combustion chamber's average pressure;

(E) generating a nominal value of the combustion chamber average pressure; and (F) adjusting the fuel-air ratio of the fuel-air mixture admitted to the internal combustion engine in accordance with the difference between the nominal and actual values.

8. A method for controlling the operation of an internal combustion engine, comprising the steps of:

(A) determining a measurement-time interval, the duration of which corresponds to an angular region of the crankshaft rotation related to at least one stroke of a piston of the engine;

(B) generating a measurement value from an engine operating parameter during the measurement-time interval, said generated measurement value varying during the measurement-time interval as a measure of the fluctuations in the time taken by the crankshaft to rotate through said angular region, and corresponding to the average combustion chamber pressure;

(C) integrating the measurement value generated;

(D) comparing an integrated measurement value generated during a subsequent measurement-time interval and generating a differential value as an actual value of the combustion chamber's average pressure;

(E) generating a nominal value of the combustion chamber average pressure; and (F) adjusting the fuel-air ratio of the fuel-air mixture admitted to the internal combustion engine in accordance with the difference between the nominal and actual values.

9. A method for controlling the operation of an internal combustion engine, comprising the steps of:

(A) determining a measurement-time interval, the duration of which corresponds to an angular region of the crankshaft rotation related to at least one stroke of a piston of the engine;

(B) generating a measurement value from an engine operating parameter during the measurement-time interval, said generated measurement value varying during the measurement-time interval as a measure of the fluctuations of the angular speed of the crankshaft over said angular region, and corresponding to the average combustion chamber pressure;

(C) integrating the measurement value generated;

(D) comparing an integrated measurement value generated during a subsequent measurement-time interval and generating a differential value as an actual value of the combustion chamber's average pressure;

(E) generating a nominal value of the combustion chamber average pressure; and (F) adjusting the amount of exhaust gas which is recycled to the intake side of the engine in accordance with the difference between the nominal and actual values.

10. A method for controlling the operation of an internal combustion engine, comprising the steps of:

(A) determining a measurement-time interval, the duration of which corresponds to an angular region of the crankshaft rotation related to at least one stroke of a piston of the engine;

(B) generating a measurement value from an engine operating parameter during the measurement-time interval, said generated measurement value varying during the measurement-time interval as a measure of the fluctuations in the time taken by the crankshaft to rotate through said angular region, and corresponding to the average combustion chamber pressure;

(C) integrating the measurement value generated;

(D) comparing an integrated measurement value generated during a subsequent measurement-time interval and generating a differential value as an actual value of the combustion chamber's average pressure;

(E) generating a nominal value of the combustion chamber average pressure; and (F) adjusting the amount of exhaust gas which is recycled to the intake side of the engine in accordance with the difference between the nominal and actual values.

11. An apparatus as defined in claim 1, further comprising:

(I) controller means, with integral control behavior, connected between said first comparator means and said servo means.

12. An apparatus as defined in claim 3, further comprising:

(O) electrical correcting means, connected between said second comparator means and said nominal value signal generator means, for correcting the electrical signals from said nominal value signal generator means.

13. An apparatus as defined in claim 1, further comprising:

(P) switching means, for interrupting the connection between said first comparator means and said servo means; and (Q) sensor means for sensing a particular engine condition and for actuating said switching means.

14. An apparatus as defined in claim 13, further comprising:

(R) control means, connectable to said servo means by said switching means when actuated, for controlling the operation of the internal combustion engine in a domain substantially different from that in which it operates when said switching means is not actuated by said sensor means, especially for operation in a domain in which the fuel-air ratio is that of a stoichiometric mixture.

15. An apparatus as defined in claim 4, further comprising:

(W) controller means with integral control behavior, disposed between said output of said bistable multivibrator and said servo means.

16. An apparatus as defined in claim 1, wherein said sensor means includes a disc with markings, mounted on said rotating drive means for defining the angular orientation thereof.

17. An apparatus as defined in claim 1, wherein said nominal value signal generator includes means for forming a signal which is proportional to the inverse third power of the rpm of the engine and constitutes a nominal value of the rotation time of said rotating drive means.

18. An apparatus as defined in claim 5, wherein each of said three electrical integrating circuits includes an integrating capacitor and, parallel thereto, a switch which can short-circuit said integrating capacitor when actuated by said pulse train generator means.

19. An apparatus as defined in claim 18, further comprising:

(X) a first interrupter switch, actuatable by said pulse train generator means and connected between the output of said nominal value signal generator means and said first comparator means.

20. An apparatus as defined in claim 19, further comprising:

(Y) circuit means, including an integrator, a second interruptor switch and a second AC amplifier means all in series, connected between said first AC amplifier means and said rectifying means.

21. An apparatus as defined in claim 20, wherein said circuit means further includes an integrating capacitor, connected to said integrator and an electronic switch in parallel with said integrating capacitor and actuatable by said pulse train generator means, for resetting said integrator to zero.

22. An apparatus as defined in claim 21, wherein said circuit means further includes a monostable multivibrator, connected to said pulse train generator means, for actuating said second interruptor switch.

23. An apparatus as defined in claim 1, wherein said servo means has an integral operational characteristic.

24. An apparatus as defined in claim 23, further comprising:

(Z) connecting means for establishing communication between the intake and exhaust manifolds of said internal combustion engine; and (AA) valve means, located within said connecting means, capable of defining the flow cross-section thereof and controlled by said servo means.

* * * * *